United States Patent [19]

Bruneau

[11] Patent Number: 4,958,795

[45] Date of Patent: Sep. 25, 1990

[54] FITTING FOR THE SORTING OF PLANS IN A VERTICAL FILING CABINET

[75] Inventor: Alain Bruneau, Montferrand Le Chateau, France

[73] Assignee: Alpia S.A., Besancon, France

[21] Appl. No.: 365,492

[22] Filed: Jun. 13, 1989

[30] Foreign Application Priority Data

Jun. 30, 1988 [FR] France ..... 88 09105

[51] Int. Cl.[5] ..... A47H 1/10

[52] U.S. Cl. ..... 248/317; 211/46; 248/228; 312/184

[58] Field of Search ..... 248/317, 340, 228, 339, 248/214; 211/45, 46, 47, 48, 162, 123, 124; 281/45; 312/184

[56] References Cited

U.S. PATENT DOCUMENTS

| | | | |
|---|---|---|---|
| 1,911,277 | 5/1933 | Helmer | 211/46 X |
| 2,094,107 | 9/1937 | Post | 248/317 X |
| 2,215,139 | 9/1940 | Uhlmann | 248/317 X |
| 2,961,269 | 11/1960 | Renfroe | 248/228 X |
| 3,684,340 | 8/1972 | Kirkorian | 312/184 X |
| 3,790,242 | 2/1974 | Sullivan | 312/184 |
| 3,891,093 | 6/1975 | Petrie | 211/46 |
| 3,913,995 | 10/1975 | Malcik | 211/46 X |
| 4,171,854 | 10/1979 | Hedstrom | 312/184 |
| 4,564,165 | 1/1986 | Grant | 248/317 X |

*Primary Examiner*—J. Franklin Foss

*Attorney, Agent, or Firm*—kane, Dalsimer, Sullivan, Kurucz, Levy, Eisele and Richard

[57] ABSTRACT

The fitting consists of a tubular profiled member (1) carrying removable teeth (2) aligned on one side of the profiled member. The cross-section of the profiled member has a rounded upper part (11), a lower part in the form of a stirrup incorporating between two walls (13) a T-shaped tenon (12) to which the teeth (2) are fastened. Each tooth (2) consists of two identical half teeth (3) comprising means of assembly (4, 5) and of fastening to the T-shaped tenon.

10 Claims, 2 Drawing Sheets

Fig.4
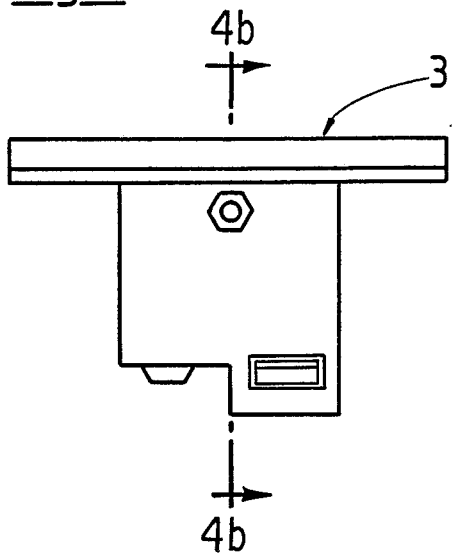
Fig.4a
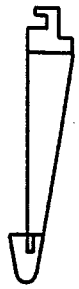
Fig.4b
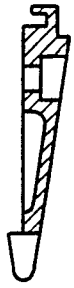
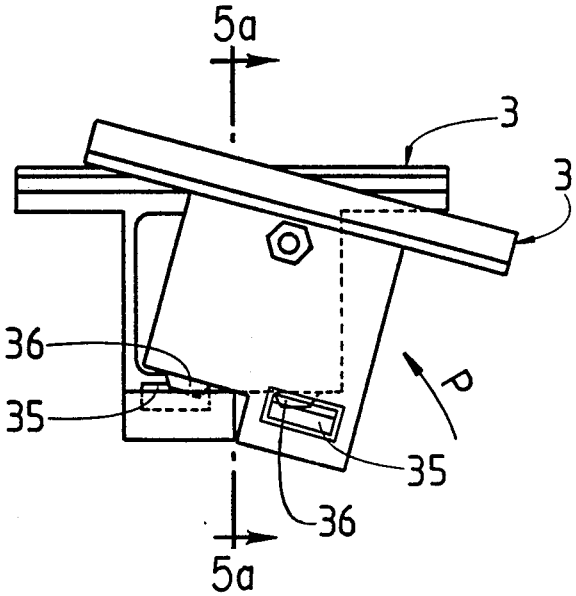
Fig.5
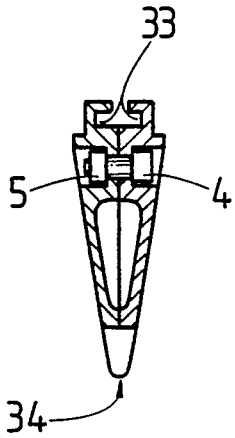
Fig.5a

FITTING FOR THE SORTING OF PLANS IN A VERTICAL FILING CABINET

FIELD OF THE INVENTION

The invention relates to a fitting for the sorting of plans in a vertical filing cabinet with suspension pins.

In all vertical filing cabinets, the removal of a plan is performed in two stages:

- a first opening stage permits the location of the plan to be extracted and the sliding of the plans upward on the pins of the movable part;
- a second opening stage permits the creation of a corridor between the fixed pins and the movable pins, allowing the extraction of the selected plan.

PRIOR ART

Two processes used for sliding the plans upward on the pins of the movable part are known:

- one process uses two selector bars:
  - one, indexed on a rack integral with the fixed part of the cabinet, retains the plans located behind this bar inside the cabinet,
  - the other, indexed on a rack integral with the movable part of the cabinet, entrains the plans located behind it at the moment when the cabinet is opened.

The selected plan is then located between the two selector bars.

- another process involves a "rake", specific to each size of cabinet and to each arrangement of the plan-carrying pins, which can be locked or otherwise and permits the sliding of the plans located in front of the selected plan from the pins of the fixed part toward the pins of the movable part or conversely.

The object of the present invention is to produce a "rake" which can be used whatever the arrangement of the pins and the curved or straight shape thereof.

SUMMARY OF THE INVENTION

To this end, the fitting or "rake" consists of a tubular profiled member carrying removable teeth aligned on the same side of the profiled member.

The cross-section of the profiled member has a rounded upper part and a lower part in the form of a stirrup incorporating between two walls a T-shaped tenon to which the teeth are fastened.

Each tooth consists of two identical half teeth comprising means of assembly and of fastening to the T-shaped tenon of the profiled member.

Each half tooth comprises, in its part closest to the T-shaped tenon, two heels for sliding on the pins and a groove for hooking the half tooth onto the T-shaped tenon of the profiled member and, in its part furthest from the tenon, on either side of an axis of symmetry CC passing through the point of assembly, on one side a rounded end having an opening and on the other side a V-shaped tenon which penetrates the opposite opening during the assembly of the two half teeth.

The main advantage offered by this fitting lies in the fact that the number of teeth and their location on the "rake" are variable, permitting adaptation to cabinets which differ in the number, the spacing and the shape of the pins.

Other advantages will emerge from the description, given by way of a nonlimiting example, of a preferred embodiment and from the drawing, in which:

BRIEF DESCRIPTION OF THE DRAWINGS:

FIG. 4 is an elevation of the outer face of a half tooth;

FIG. 4*a* is a view from the left of FIG. 1;

FIG. 4*b* is a section along CC of FIG. 4;

FIG. 5 is a front view of the half teeth in the process of assembly to form a complete tooth; and FIG. 5*a* is a section along DD of FIG. 5.

DESCRIPTION OF THE PREFERRED EMBODIMENT

Figure 1:
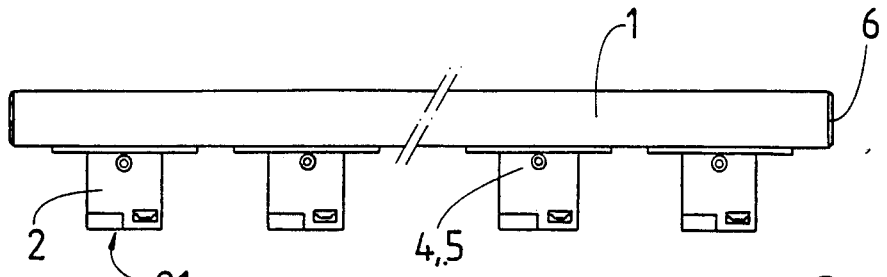
FIG. 1 is a general view.
Figure 1B:
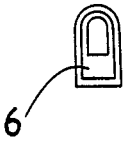
FIG. 1*b* is a view of an end cap.
Figure 1A:
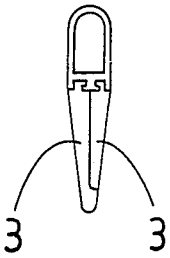
FIG. 1*a* is a view of the left end of FIG. 1 (without end cap)

FIG. 1 shows the fitting for the sorting of plans in the form in which it consists of a tubular profiled member 1 made of anodized aluminum, to which there are fastened teeth 2 each formed of two half teeth 3 joined by a single bolt 4 with its nut 5. Each end of the profiled member is closed by a cap 6 made of plastic which totally blocks the section of the profiled member and has no roughness on the outside. The width of the lower part 21 of the tooth 2 permits its use in a cabinet fitted with small pins having a pitch of 60 mm.

Figure 2:
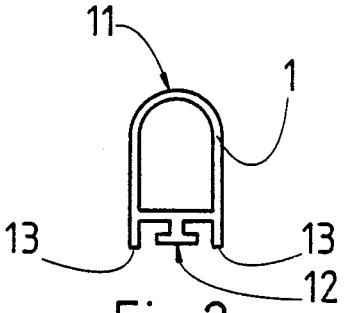
FIG. 2 is a cross-section of the profiled member.

The cross-section of the profiled member 1 shown in FIG. 2 makes it possible to see the rounded upper part 11, the body in the form of a stirrup containing a T-shaped tenon 12 inserted between two walls 13.

This T-shaped tenon permits the fastening of the teeth 2 by means of grasping said tenon between the two assembled half teeth.

The teeth 2 are each composed of two half teeth 3 made of plastic which are assembled facing one another (FIGS. 3 and 4), are slid on the T-shaped tenon 12 of the profiled member 1 and then locked by a single bolt 4 with its nut 5 in a chosen position, corresponding to the spacing of the pins in the cabinet in question.

The number of teeth will be predefined for each type of cabinet, but it will be possible to increase the number as required.

Figures 3, 3A, 3B:
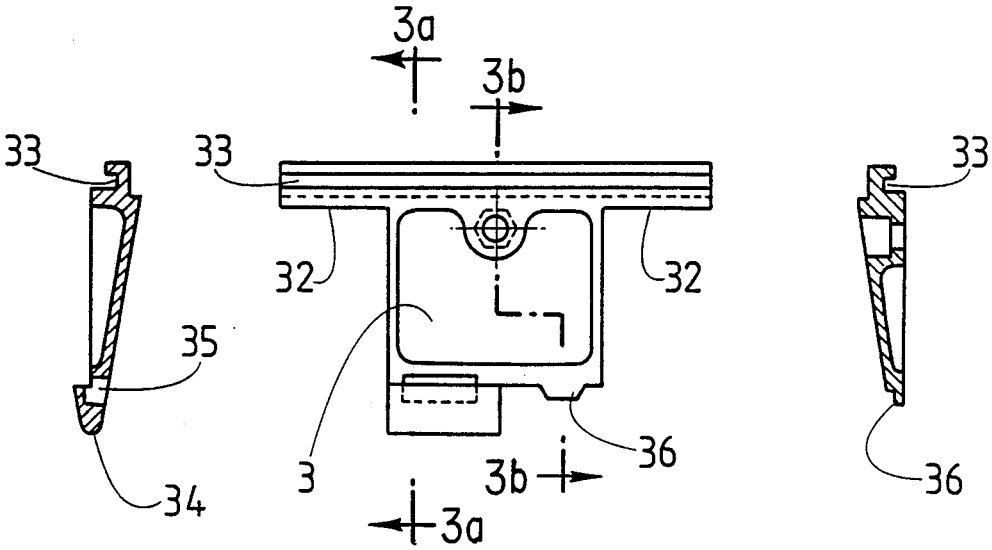
FIG. 3 is an elevation of the inner face of a half tooth.
FIG. 3*a* is a section along A—A of FIG. 3.
FIG. 3*b* is a section along B—B of FIG. 3.

Each half tooth 3 comprises:

- on the part close to the profiled member 1,
  - two heels 32 for sliding on the pins of the cabinets, preventing wear of said pins, these heels 32 being situated on either side of the solid part of the half tooth 3, one face of which is shown in FIG. 3;
  - a continuous strip having a groove 33 for hooking the half tooth onto the T-shaped tenon 12 of the profile 1, this strip comprising the two heels 32, and
- on the free part,
  - a rounded tooth end 34, inside which an opening 35 is formed, into which opening-, during assembly, the tenon 36 of the opposite half tooth is slipped, preventing the separation of one half tooth from the other after assembly.

The means for assembling the two half teeth 3 consist, in the part of the half tooth closest to the profiled member 1, of the groove 33, complemented by the same groove of the other half tooth, hooking onto the wings of the T-shaped tenon 12 and, in the free part of the half tooth, of the V-shaped tenon 36 of one half tooth fitting into the opening 35 of the other half tooth to form together a rounded end 34 of the complete tooth 2 (FIG. 5*a*).

A single bolt 4 and its nut 5 fixed in terms of rotation make it possible to hold the preassembled half teeth together while the tooth slides in the profiled member, and make it possible to fix the tooth in a predetermined position.

The design of the teeth in two parts meets the following objectives:

(a) to produce a component of small dimensions using smaller tools, which is thus less costly;

(b) to use a mold of simple design in order to manufacture a component which is easy to remove therefrom: on the half tooth 3 the opening 35 can be seen which is a simple means of creating a housing for the tenon 36;

(c) to produce a smooth surface on the tooth: the creation of two half teeth 3 permits reliefs—inevitable when molding a plastic component—reliefs which are situated inside the tooth after the assembly of two half teeth;

(d) to carry out the mounting and the adjustment easily: a single machining suffices on the profiled member 1: its setting to length;

since the preassembly of the two half teeth 3 takes place outside the profiled member, the tooth 2 thus composed can be slid onto the T-shaped tenon 12 and then displaced to adapt it to the configuration of the pins of the cabinet without it coming off the profiled member 1; a simple key suffices to lock the tooth 2 in place, the nut 5 is immobilized in a shaped housing;

(e) to produce the correct behavior on use:

the profile comprises two walls 13 which serve effectively to hold the heels 32 of the half teeth 3 together over their entire length, thus preventing any separation of one from the other;

the half teeth 3 are assembled by means of the tenons 36 which are V-shaped to facilitate their introduction into the opening 35, which prevents any deformation of the tooth 2 by disjunction of the two elements which constitute it;

(f) to ensure safe usage: the presence of the caps 6 placed at the ends of the profiled member 1 after its setting to length prevents any damaging rough edges.

I claim:

1. A fitting for sorting of plans in a vertical filing cabinet with suspension pins, comprising:

a tubular profiled member (1) with a support tenon (12) extending downwardly;

a plurality of teeth (2), each tooth (2) consisting of two half teeth, each half tooth including an opening (35) and a corresponding coupling tenon (36), said opening and said coupling tenon cooperating to interlock the two half teeth, with the coupling tenon of one tooth being disposed in the corresponding opening of the other half teeth; and means (4,5) for fastening said teeth to said support tenon by urging said half teeth toward each other.

2. The fitting as claimed in claim 1, wherein the ends of the tubular profiled member (1) are each blocked by a solid cap (6) and wherein the outer periphery of this cap corresponds exactly to the outer periphery of the section of the profiled member.

3. The fitting of claim 1 wherein said profiled member (1) has a rounded upper part (11).

4. The fitting of claim 3 wherein said profiled member further includes a lower part having two parallel walls 13, said support tenon 12 being disposed between said walls (13).

5. The fitting of claim 4 wherein said support tenon is T-shaped.

6. The fitting of claim 1 wherein said two half teeth are identical.

7. The fitting of claim 5 wherein each half teeth comprises an upper tooth part including two heels (32) sliding on said tubular member (1) and a groove (33) for hooking said half tooth to said T-shaped tenon (12).

8. The fitting of claim 1 wherein each said teeth has a vertical axis of symmetry with the opening and coupling tenon of each half teeth being disposed on opposite sides of said axis of symmetry.

9. The fitting of claim 8 wherein said axis of symmetry passes through said means for fastening (4,5).

10. A fitting for the sorting of plans in a vertical filing cabinet with suspension pins, said fitting comprising:

a. a tubular profile member having a longitudinal extension oriented downwardly;

b. a plurality of teeth for holding plans, each tooth comprising a first tooth part and a second tooth part substantially identical to said first tooth part, each said tooth parts having an upper section with groove means, said tooth parts being disposed facing each other with said groove means being disposed on opposite sides of said extension; and c. securing means attached to said teeth for securing said teeth to said profile member, said securing means having an open and a closed configuration, in said open configuration said securing means allowing said tooth parts to slide with respect to said profile means, and in said closed configuration said securing means urging said first and second tooth parts toward each other to clamp said extension therebetween; and d. wherein each said first and second tooth part includes a tooth opening (35) and a coupling tension (36), said tooth opening and said coupling tenon cooperating to interlock said first and second tooth parts, with the coupling tenon of one tooth part being disposed in the corresponding opening of the other tooth part.

* * * * *